252-104 AU 166 EX
3/7/78 XR 4,077,878

United States Patent [19]

Jackson

[11] 4,077,878

[45] Mar. 7, 1978

[54] IN PROCESS PURIFICATION OF DRY CLEANING SOLVENTS

[76] Inventor: Herman Roy Jackson, 1981 San Marco Blvd., Jacksonville, Fla. 32207

[21] Appl. No.: 657,332

[22] Filed: Feb. 11, 1976

[51] Int. Cl.[2] ..... B01D 39/04

[52] U.S. Cl. ..... 210/59; 8/142; 210/60; 210/63 R; 210/167; 210/243; 210/282; 210/507; 252/104; 252/163; 252/172

[58] Field of Search ..... 8/141, 142; 134/10, 134/13; 210/23 R, 24, 29, 39, 41, 50, 59, 60, 63 R, 167, 243, 282, 507, 506, 504; 252/104, 163, 172; 428/264, 539

[56] References Cited

U.S. PATENT DOCUMENTS

| | | | |
|---|---|---|---|
| 2,475,418 | 7/1949 | Aitchison | 8/142 |
| 2,729,576 | 1/1956 | Trusler | 8/142 |
| 3,212,641 | 10/1965 | Komarmy et al. | 210/509 |
| 3,231,324 | 1/1966 | Young | 210/501 |
| 3,658,459 | 4/1972 | Gartlan | 8/142 |
| 3,724,177 | 4/1973 | Grote | 55/316 |
| 3,766,075 | 10/1973 | Jackson | 252/163 |

FOREIGN PATENT DOCUMENTS

| | | | |
|---|---|---|---|
| 1,245,896 | 8/1967 | Germany | 8/142 |

*Primary Examiner*—Charles N. Hart
*Assistant Examiner*—Peter A. Hruskoci
*Attorney, Agent, or Firm*—Sughrue, Rothwell, Mion, Zinn and Macpeak

[57] ABSTRACT

Residual moisture and sulfur and other residual reducing agent impurities contained in dry cleaning solvents are removed by adding to the solvents an unsubstituted aromatic hydrocarbon or a halogen or alkyl-substituted aromatic hydrocarbon and a cellulosic container device. The cellulosic container device comprises a cellulosic bag which contains another cellulosic material on which has been coated a chromate compound, the chromate compound being sealed onto the cellulosic material by use of a polymeric material or a cellulosic gum, the cellulosic bag also having attached thereto one or more copper wires to provide a continuous electrical ground to the vessel containing the solvent or to a D.C. power supply. The same cellulosic container device can be added to petroleum liquids together with naphthalene and fatty acids to remove sulfur impurities therefrom.

17 Claims, No Drawings

IN PROCESS PURIFICATION OF DRY CLEANING SOLVENTS

BACKGROUND OF THE INVENTION

1. Field of the Invention

The present invention concerns improving the cleaning properties of organic solvents used in dry cleaning operations, and especially, concerns improving the cleaning properties of such organic dry cleaning solvents by removing residual moisture therefrom as well as sulfur and other residual reducing agents by the oxidation of the same. More specifically, the present invention relates to an improved dry cleaning operation as compared to my prior U.S. Pat. No. 3,766,075 issued on Oct. 16, 1975.

2. Description of the Prior Art

In commercial dry cleaning operations, various types of organic solvents have been employed in the past in the dry cleaning process to remove soils from fabrics and clothing. For example, the prior art has employed solvents such as halogen-substituted aliphatic hydrocarbons such as perchloroethylene (tetrachloroethylene), mineral spirits, various types of petroleum solvents, mixtures of hydrocarbon and halogen-substituted hydrocarbon solvents with detergents, and the like. Typically, the solvents employed in dry cleaning operations have a boiling point in the range of from about 100° to about 400° F and a surface tension of from about 20 to about 30 dynes/cm at room temperature (i.e., 20° C) as measured against an air interface. A typical prior art formulation of a halogenated hydro-carbon solvent-detergent combination is manufactured by DuPont and sold under the trade name Valclene, which is a combination of a fluorocarbon solvent and a special high-performance detergent with a boiling point of about 118° F, a density of about 13.16 pounds per gallon at 68° F and a surface tension at 68° F of about 20 dynes/cm. A suitable fluorocarbon solvent is trichlorotrifluoroethane as the solvent constituent for Valclene.

Other solvents such as carbon tetrachloride and methylisobutylketone have also been employed in the past in commercial dry cleaning operations. Due to the good stability and relatively high cost of these solvents, they are naturally reused and continuously recycled in the dry cleaning process, and thus it becomes desirable to recondition the solvents by removing residual moisture, sulfur, and other residual reducing agents therefrom in order to provide reconditioned solvent for cleaning successive batches of soiled fabrics and clothing.

The prior art, in an effort to remove such impurities from dry cleaning solvents, suggests that the formulations used as the solvents be distilled after the drying cleaning operation; however, distillation is normally expensive and sometimes difficult to conduct without costly equipment, and problems arise in some instances because of the loose additives present in the dry cleaning mixtures.

Another suggested solution for the removal of the impurities from the solvents is by a filtration and absorption technique wherein the impurities are selectively removed from the solvents after the same have been used to clean soiled fabrics. However, the use of such techniques is disadvantageous in that equipment cost becomes high, and other mechanical problems with respect to the apparatus prevent this method from being efficiently conducted. In addition, the loose additives which may be present in the dry cleaning formulation may tend to inhibit effective filtration and absorption.

The prior art also suggests the addition of water to common formulations of dry cleaning mixtures in order to improve the dry cleaning characteristics of the solvents employed for the cleaning operations. Normally, water would be added to dry cleaning solvents to enable the solvents to dissolve water-soluble components of stains on fabrics or clothing. However, most modern fabrics are non-wettable and the presence of water, even in small amounts, prevents the organic solvents, which are generally non-polar in nature, from dissolving slightly polar stains such as fats, etc., in the solvents since the stains become hydrated through dipole-dipole bonding with the water molecules.

During the dry cleaning operation, the relative humidity of the solvent changes according to the humidity of the ambient air and that present in the fabric or clothing being cleaned. Normally, the relative humidity of the solvents is maintained at about 65 to 70% in order to dissolve, for example, salts and sugars from stains. However, the control of the amount of moisture which is present in organic dry cleaning solvents is very important, since serious problems are encountered if the amount of moisture in the solvents becomes eiter too high or too low.

Too much moisture in dry cleaning solvents may result in fiber shrinkage or distortion, the dulling of colors of the fabrics or clothing being cleaned and possible fading of the fabrics. In addition, fabrics become harder to press following cleaning. Too low a moisture level in the solvent results in the redepositing of water-soluble substances on the fabrics or clothing being cleaned, with the result that stains cannot be effectively removed. Further, a low moisture content in the dry cleaning solvent may result in carbon being redeposited on the fabric, thereby adversely affecting the color of the fabric and leaving the fabric with static electricity charges which make it uncomfortable for a person to subsequently wear the clothing; in addition, the presence of static electricity charges present a danger of explosion with certain types of solvents.

In addition to the problems inherent in the use of dry cleaning solvents containing too much or too little moisture, other problems are apparent due to the presence of impurities such as sulfur and other reducing agents in dry cleaning solvents. Such impurities may deposit on the fibers of the clothing being cleaned, resulting in discoloration and spotting thereof, or their presence in the solvents may result in fading of the colors of the fabrics being cleaned, may cause odors to remain on the cleaned products, and in addition, especially with respect to sulfur impurities, may cause corrosion of the equipment being used to clean the material.

In my prior Pat. No. U.S. 3,766,075, on invention was disclosed wherein residual moisture and impurities contained in typical formulations of dry cleaning solvents could be removed (without creating the adverse effects known to the prior art) by adding an unsubstituted aromatic hydrocarbon or a halogen or alkyl-substituted aromatic hydrocarbon together with a dried cellulosic material onto which has been precipitated a fine deposit of an oxidizing agent such as lead dichromate to an organic dry cleaning solvent. The treated cellulosic material was disclosed as absorbing excess moisture present in the solvent mixture as well as removing impurities therefrom through oxidation by means of the employed dichromate.

The present invention is an improvement on the preceeding dry cleaning composition and method.

Accordingly, it is a principal object of the present invention to provide a means of removing residual moisture from typical formulations of dry cleaning solvents.

It is a further object of the present invention to provide improved dry cleaning compositions free of residual moisture and impurities, without the adverse effects shown in the prior art.

It is a further object of the present invention to provide a method of removing impurities contained in the solvents as a result of the dry cleaning operation.

It is a further object of the present invention to provide a method of dry cleaning using such improved dry cleaning solvents.

It is a further object of the present invention to provide a cellulosic container device which can be employed in dry cleaning solvents to improve the dry cleaning operation.

Other objects and advantages of the present invention will become apparent from the ensuring description.

SUMMARY OF THE INVENTION

The present invention provides an improved dry cleaning composition which comprises an organic dry cleaning solvent to which has been added an unsubstituted or halogen or alkyl-substituted aromatic hydrocarbon together with a dried cellulosic material onto which has been coated a mixture of (1) chromates, including dichromates, such as lead chromate or lead dichromate, which can form into a solid when dried, and (2) a sealing compound such as a polymeric material or a cellulosic gum, the dried cellulosic material being itself contained in a cellulosic container, such as a cellulosic bag, which is electrically grounded to a tank, such as a dry cleaning base tank in which the dry cleaning operation is conducted, or to a D.C. power supply.

DESCRIPTION OF THE PREFERRED EMBODIMENTS

Generally, the present invention is applicable to any type of organic dry cleaning solvent normally employed in dry cleaning operations. Many types of solvents are well-known in the art, as indicated by the above discussion, and those of ordinary skill in the art will realize that the efficacy of the present invention is not limited to a certain class of organic dry cleaning solvents. Preferably, the solvents which are employed in the present invention are aliphatic halogen-substituted hydrocarbons or more preferably petroleum solvents having a boiling point in the range of from about 100° to about 400° F and a surface tension of from about 20 to about 30 dynes/cm at 20° C. Typical examples of such halogen-substituted aliphatic hydrocarbons are trichlorotrifluoroethane, carbon tetrachloride, perchloroethylene, and the like. Typical suitable petroleum solvents are mineral spirits, petroleum ethers, methylsiobutyl ketone and the like. It is to be specifically understood, however, that the present invention is especially applicable to any petroleum solvent having the above properties.

The present invention contemplates adding to such organic dry cleaning solvents an unsubstituted aromatic hydrocarbon or a halogen or alkyl substituted aromatic hydrocarbon having a boiling point between about 78° and 250° C. Typical examples of suitable unsubstituted aromatic hydrocarbons are benzene and naphthalene. Suitable alkyl-substituted aromatic hydrocarbons are lower alkyl, preferably methyl- or ethyl-, substituted aromatic hydrocarbons, such as xylene, toluene, and the like. Further, suitable halogen-substituted aromatic hydrocarbons are chlorobenzene and the like. However, the present invention is expressly applicable to those compounds satisfying the above property, although not specifically enumerated in the present specification. Those of ordinary skill in the art, with a minimum degree of experimentation, are certainly able to practice the present invention using aromatic compounds having the necessary boiling point but not specifically identified herein, according to the end use desired.

Generally, the amount of the above-identified aromatic compound which is incorporated into the organic dry cleaning solvent composition varies from 3 liquid ounces to 1 gallon of aromatic compound per 100 gallons of organic solvent. The particular amount of a specific aromatic hydrocarbon may vary within this range depending upon the aromatic hydrocarbon selected; however, an amount of aromatic hydrocarbon within this range is generally suitable for the purposes of the present invention.

As indicated above, the present invention also contemplates the addition of a cellulosic bag device to the organic dry cleaning solvent which comprises a cellulose material which can be folded upon itself so as to be closed and thereby form a "bag" and which contains another cellulosic material which has had coated thereon a dried mixture of chromate and a sealing agent such as a cellulosic gum, for example, carboxymethyl cellulose, or a suitable polymeric material such as polypropylene, nylon or cellulose acetate (as long as it acts to seal the dried chromate compound onto the cellulosic material). Any chromate or dichromate compound can be employed as long as a solid is formed when the chromate is dried. Chromate compounds other than lead chromate or lead dichromate, such as barium chromate, may actually be preferred for environmental reasons. Typical cellulose materials include, for example, cotton rags, cotton cloth or plain cloth, cotton towelling, or any other material containing cellulose fibers. Generally, any amount of the dried cellulosic material (i.e., the cellulosic material inside the cellulosic "bag") can be added to the dry cleaning solvent per 100 gallons of the organic solvent as the amounts are not critical. The larger the amount (surface area) of the dried cellulosic material used, the greater the contact of the organic dry cleaning solvent with the chromates, and thus the better the results.

The chromate or dichromate compound can be coated onto the cellulosic material by painting with an aqueous mixture of chromate and sealing compound or by dipping the cellulosic material into a tank containing the aqueous mixture of chromate-sealing compound.

According to one preferred embodiment, the cellulosic bag device is produced in the following manner:

First, a mixture is prepared which contains chromate (such as, for example, lead chromate), carboxymethyl cellulose and water, the amounts of the ingredients and the proportions thereof being variable, the only requirement being the sufficient amounts of (lead) chromate and carboxymethyl cellulose are used to provide sufficient dry cleaning action with the ultimately produced "bag" product.

Second, the aqueous solution of (lead) chromate and carboxymethyl cellulose is then coated onto one or both sides of a cellulose material, in any number of coating applications such that the desired amount of mixture is coated on and impregnated into the cellulose material. The cellulose material can preferably comprise a cotton towel, and can generally be on the order of 2 × 3 feet in dimensions, although other sizes, either larger or smaller can operate successfully.

Next, the coated cellulose material is allowed to dry.

After the coated cellulose material is dried, additional coatings of carboxymethyl cellulose in aqueous solution can be applied thereto, the coating solutions either containing or optionally not containing (lead) chromate.

The thus-coated cellulose material is then dried as before. By following the foregoing procedure, a 2 × 3 feet cotton towel can be made to hold typically 300–400 grams of (lead) chromate or more. The greater the total amount of (lead) chromate coated onto the cellulose material, the longer the useful life of the treated cellulose material when used according to the invention.

Finally, in order to produce the bag product of the present invention, the obtained coated cellulose material is then placed within a cellulose container, preferably a cotton bag, and the bag is then closed (e.g., sewn). Optionally, more than one cellulose container can be used in accordance with the present invention, i.e., one cellulose container, after closing, can then be placed in another cellulose container, which itself is then closed, etc.

After the bag device has been fabricated, it can then be placed in a base tank of a dry cleaning washer (together with the required amount of aromatic compound), but only after it has been electrically connected to a ground and has been weighted down by a sufficiently heavy weight (in order to keep the bag device submerged). The "ground" can be produced by wrapping a copper wire around the bag device at different corners thereof with sufficient dangling wire left over to contact the walls of the base tank during the dry cleaning cycle. Alternatively, and for better results, the copper wire is connected to the negative terminal of a low voltage D.C. power supply (the positive terminal of which is connected to a ground), the copper wire being insulated from electrical contact with any intermediate "grounds." In this way the cellulosic bag device is placed in the dry cleaning solvent located in the dry cleaning washer. More than one cellulosic bag device can be added to the dry cleaning solvent to obtain even better results, although as long as the dry cleaning solvent goes through the bag, then only one bag device is actually needed for the present invention to operate successfully.

A typical chromate mixture can be formed by mixing 2 parts of barium chloride with 3 parts of sodium dichromate with water, water washing the solid precipitate formed several times, and recovering the dried product. Alternatively, 1 part of chromic acid can be mixed with 2 parts of barium chloride, etc.

The chromates can then be placed on the cellulosic material, if desired, and sealed with an aqueous solution of carboxymethyl cellulose. Alternatively (as noted above), the chromates can be mixed with an aqueous solution of carboxymethyl cellulose first, and then applied to the cellulosic material. The carboxymethyl cellulose acts to seal the chromates on the cellulosic material so that even during prolonged use the chromates will not wash away. In this regard, in my previous U.S. Pat. No. 3,766,075 the chromates used would eventually wash off the dried cellulosic material (cotton rags) and the advantageous results of the invention would be seriously reduced, or ultimately lost.

It has been determined that adding the aromatic hydrocarbon and the cellulosic material, within the ranges above stated, to an organic dry cleaning solvent, effectively eliminates residual moisture from the dry cleaning solvent, without being accompanied by the defects of the prior art. More specifically, the prior art indicates that at extremely low humidities, carbon becomes redeposited on the clothes being cleaned, resulting in adverse static electricity effects. However, the dry cleaning compositions of the present invention remove large amounts of soil without redepositing on the clothing being observed. Further, the adverse static electricity effects noticed when prior art compositions are employed at low humidities are substantially eliminated by the present invention, and therefore, the wearer of the clothing after cleaning does not experience uncomfortable effects therefrom, and in addition, the reduction of static electricity charges in the clothing reduces any explosion hazard which may exist depending upon the particular solvent employed.

The use of the compositions of the present invention in normal commercial dry cleaning operations results in extremely uniform cleaning, without the adverse effects of shrinkage, color fading, dullness of colors, etc. In addition, stains comprised of carbon, salt, sugar, fats, etc., in the clothes being cleaned are substantially completely removed from the clothes without any adverse effects. Thus, the present invention provides an improved dry cleaning composition which enables those skilled in the art to achieve extremely uniform dry cleaning operations without the adverse effects of the prior art.

It is believed that the chromates on the cellulosic material also remove impurities such as sulfur compounds from the clothes being dry cleaned by oxidizing the same to sulfite or sulfate, which then can be removed either as a precipitate or by dissolving the same in the water absorbed on the cellulosic material.

The use of chromates in the present invention, such as barium chromate, i.e., the chromates which form solids when dry, can be considered to be an improvement over the use of lead dichromate in my prior U.S. Pat. No. 3,766,075 since larger amounts thereof can be effectively used without any detrimental side effects, a better dry cleaning action can be obtained, and the dry cleaning operation becomes more economical since no sulfuric acid is needed in order to form the mixture thereof for application to the cellulosic material (to be employed within the cellulosic bag).

The cellulosic bag container is itself employed in order to protect the contained cellulosic material from undue agitation during the dry cleaning process and thereby extend its useful life.

Also, the cellulosic bag container allows for constant electrical contact with the base tank or with the negative terminal of a D.C. power supply (due to the wires attached thereto), which is a distinct improvemnt over U.S. Pat. No. 3,766,075 wherein the cotton rags would be grounded only as they haphazardly touched the sides of the base tank washer. The cellulosic gum (polymeric material or carboxymethyl cellulose) seals the chromates onto the cellulosic material and thereby reduces the hazard of lead pollution of the dry cleaning solvent (i.e., if lead chromate is used, less of it is lost from the cellulosic material onto the solvent than in U.S. Pat. No. 3,766,075) and extends the life of the cellulosic material.

As mentioned above, the most preferable organic dry cleaning solvents are the petroleum solvents having the boiling points and surface tensions above indicated. In addition, halogen-substituted aliphatic hydrocarbons such as trichlorotrifluoroethane and perchloroethylene can be employed. Generally, the present invention is applicable to any known organic dry cleaning solvent, with those of ordinary skill in the art being able to select appropriate solvents depending upon the conditions of operation, the particular type of clothing or fabric being cleaned, the temperatures of operation, the types of stains to be removed, etc.

It has further been found that the addition of from about ½ to about 5% by weight, based on the weight of the organic dry cleaning solvent, of a hydrocarbon of a high boiling point, such as white oil, increases the ease of removal of carbon, salt and sugar deposits from clothes in the dry cleaning process. One type of useful white oil is Chevron No. 72 which is a well-known technical oil.

As another embodiment of my invention, it has been further discovered that sulfur impurities may be removed from petroleum products such as crude oil, gasoline, jet fuel, diesel oil, and like petroleum products, in an improved fashion by adding thereto the cellulosic container device as previously described, in conjunction with a small amount of naphthalene. The naphthalene is added to the petroleum products in an amount of from about 2 liquid ounces or more per 100 gallons of the petroleum liquid, depending upon the amount of impurities present. The cellulosic container device, which has the copper wires attached thereto, is electrically grounded to the vessel in which the petroleum products are contained (or connected to a D.C. power supply) in the same fashion as described previously with respect to the organic dry cleaning solvent purification embodiment of this invention.

Further, as noted in my previous U.S. Pat. No. 3,766,075, it has been found that a small amount of water should be present in the petroleum products containing the cellulosic container device and the naphthalene. Generally, from about 1 pint to about 1 gallon of water should be present per 100 gallons of the petroleum products. If this amount of moisture is not present in the petroleum products, it should be added thereto to allow for the necessary oxidation and reduction process to occur. The temperature at which the petroleum liquid should be maintained during removal of impurities therefrom by the use of such a composition is aout 20° F below the boiling point of the treated material. Of course, this temperature may vary as desired, with the proviso that the use of a low temperature results in the removal of the impurities taking a longer time. Generally, by operating within the parameters above indicated, the removal of sulfur compounds from petroleum products, such as gasoline, is very effective by the use of such a composition.

Although the reason why these materials will remove sulfur impurities from petroleum products is not specifically known, it is believed that the naphthalene undergoes an endothermic reaction which causes the atoms in the naphthalene molecule to come closer together, thus giving off a small amount of electric current which is attracted by the cellulosic material (which has the capability of transmitting an electric current). The chromate molecules contained on the cellulosic material probably oxidize the sulfur compounds which are contained in the petroleum products to sulfate, sulfite, etc., which can be removed by any suitable means such as filtration through a filter, using as a filter aid cellulose pulp. It is important to remove sulfur from petroleum products such as gasoline, since sulfur compounds present therein adversely effect any lead additive which may be present in the gasoline. The addition of the above materials to petroleum products, such as gasoline, would diminish or substantially eliminate this effect and increase the efficienty of the lead additive contained in the gasoline (i.e., increase the mileage to be drived per unit volume of gasoline).

Obviously, as a result of the generation of the electric current, the vessel in which the liquid is contained should be grounded or else connected to the negative terminal of a D.C. power supply.

In another embodiment of the present invention, the cellulosic container device can be placed in a petroleum fuel tank (or fuel line) containing crude oil, or hydrocarbon fuels obtained from shale or coal, together with naphthalene and a soluble organic acid, preferably a short-chain, high acid number, low iodine-containing fatty acid such as sebacic acid, (although longer-chain acids can also be used, e.g., oleic acids, stearic acids, etc.) in order to enhance the combustion characteristics of the fuel and add to its burning time by sulfur removal therefrom. In this embodiment, the cellulosic material with the cellulosic bag container is impregnated with barium chromate and sealed therein with carboxymethyl cellulose (or other polymer substances) and the cellulosic bag device made in the same way as discussed previously. The naphthalene is added to the fuel in a range of 2 to 5 ounces of naphthalene per 100 gallons of fuel, and the organic acid is added in a similar range. Water in a small should be added as in the previous embodiment. More of each of these additives depending on their solubility in the fluid (up to their saturation point) can be employed if desired. It is believed that the naphthalene undergoes an endothermic reaction which causes the atoms in the naphthalene molecule to come closer together, thus giving off a small amount of electric current (from the hydrogen atoms). The cellulosic material (cotton towel) carries the current and the atoms in the barium chromate become ions. The organic acids in the fuel oxidize and become carbon dioxide and water and provide the $H+$ ions to facilitate the oxidation process. This oxidation facilitates the ultimate combustion properties of the fuel. It should be noted that this embodiment can also be used to purify and improve the dry cleaning properties of dry cleaning fluids.

It should furthermore be specifically noted that with respect to this latter embodiment of the invention, the cellulose "bag" previously described in actuality need not be employed to contain the coated and impregnated cellulose material, i.e., provided that the cellulose material has attached thereto a copper wire or wires of sufficient length that a constant grounding with the encompassing vessel (or to a D.C. power supply) for the petroleum liquid (or dry cleaning fluid) is maintained.

If, in the previous embodiment of my invention, the cellulosic material impregnated with the chromate compound is in fact connected to the negative terminal of a D.C. power supply, the requirement to add naphthalene to the petroleum or dry cleaning liquids is eliminated.

The above description should not be taken as limiting the present invention to the actual embodiments specifically disclosed, but should be deemed to describe equivalents thereof which may be employed in the practice of the present invention. Those of ordinary skill in the art may make suitable modifications of the present invention according to the above description, without departing from the scope thereof.

I claim:

1. A cellulosic container device for use in removing impurities from organic dry cleaning solvents and petroleum liquids which comprises a cellulosic material which has been coated with a chromate compound, said chromate compound being sealed on said cellulosic material with a sealing compound, said cellulosic material being enclosed within a cellulosic bag which is sealed closed, said cellulosic bag having one end of at least one grounded copper wire attached thereto.

2. The cellulosic container device of claim 1, wherein said cellulosic material is a cotton towel.

3. The cellulosic container device of claim 1, wherein said cellulosic bag is a cotton cloth which has been sewn closed.

4. The cellulosic container device of claim 1, wherein said chromate compound is barium chromate.

5. The cellulosic container device of claim 1, wherein said sealing compound is a cellulosic gum.

6. The cellulosic container device of claim 5, wherein said cellulosic gum is carboxymethyl cellulose.

7. The cellulosic container device of claim 1, wherein said sealing compound is polypropylene.

8. The cellulosic container device of claim 1, wherein a weight is attached to said cellulosic bag.

9. The cellulosic container of claim 1, wherein said wire is connected to the negative terminal of a D.C. power supply, the positive terminal of which is grounded.

10. A method of removing impurities and residual moisture from organic dry cleaning solvents comprising adding to said solvents an unsubstituted or halogen- or alkyl-substituted aromatic hydrocarbon and immersing the cellulosic container device of claim 1 in the dry cleaning solution.

11. The method of claim 9, wherein said organic dry cleaning solvent is a halogen-substituted aliphatic hydrocarbon or a petroleum solvent having a boiling point of from about 100° to 400° F and a surface tension of from about 20 to about 30 dynes/cm.

12. The method of claim 9, wherein said chromate compound is barium chromate.

13. The method of claim 9, wherein from about 3 ounces to about 1 gallon of said unsubstituted or halogen- or alkyl-substituted aromatic hydrocarbon is added to every 100 gallons of said organic dry cleaning solvent, and wherein from about 1 to about 25 pounds of said cellulosic material is employed in said cellulosic bag, per 100 gallons of said organic dry cleaning solvent, is added.

14. The method of claim 9, wherein said cellulosic material is cotton.

15. The method of claim 9, wherein the copper wire attached to said cellulosic bag contacts the vessel in which the organic dry cleaning solvents are contained.

16. The method of claim 9, wherein the copper wire attached to said cellulosic bag is connected to the negative terminal of a D.C. power supply, the positive terminal of the D.C. power supply being grounded.

17. The method of claim 10, wherein said unsubstituted aromatic hydrocarbon is naphthalene.

* * * * *